United States Patent [19]

Ohmori

[11] Patent Number: 4,724,992

[45] Date of Patent: Feb. 16, 1988

[54] ELECTRIC TACKER

[75] Inventor: Toshitaka Ohmori, Saitama, Japan

[73] Assignee: Olympic Company, Ltd., Saitama, Japan

[21] Appl. No.: 883,723

[22] Filed: Jul. 9, 1986

[30] Foreign Application Priority Data

Nov. 7, 1985 [JP] Japan ..... 60-172074[U]
Dec. 28, 1985 [JP] Japan ..... 60-203776[U]
Apr. 25, 1986 [JP] Japan ..... 61-63659[U]

[51] Int. Cl.[4] ..... B25C 7/00
[52] U.S. Cl. ..... 227/146; 227/132
[58] Field of Search ..... 227/146, 147, 131, 121, 227/132, 142

[56] References Cited

U.S. PATENT DOCUMENTS 3,203,610 8/1965 Farrell ..... 227/131
3,589,588 6/1971 Vasker ..... 227/131
3,847,322 11/1974 Smith ..... 227/131
4,183,453 1/1980 Barrett et al. ..... 227/120

FOREIGN PATENT DOCUMENTS 60-135182 7/1985 Japan .

*Primary Examiner*—E. R. Kazenske
*Assistant Examiner*—James Wolfe
*Attorney, Agent, or Firm*—Sandler & Greenblum

[57] ABSTRACT

The present invention relates to an improvement in an electric tacker covered by a motor battery operated for hammering inverted U-shape needles, T-shape tacks or nails or inverted L-shape staples, and more specifically to an improvement in a continous hammering preventive mechanism for needles tacks, nails or staples, including a staple idle hammering mechanism and a mechanism for displaying the remaining quantity of staples.

4 Claims, 22 Drawing Figures

ELECTRIC TACKER

BACKGROUND OF THE INVENTION

1. Field of the Invention

The present invention relates to tackers, staples, and power-hammers, and specifically to such power tools provided with a continuous hammer preventive mechanism which includes an idle hammering mechanism.

2. Discussion of Background and Material Information

Manual tackers and staples are well known. In a manual type of such a device, however, the hammering of a needle tack nail or staple requires manual labor, and the size of a needle to be hammered is somewhat limited by the physical capabilities of the laborer. Consequently, the amount of work which can be accomplished is limited accordingly.

In an attempt to improve conventional tools of this type, tools were developed which utilize air pressure to drive the hammer. Such air actuated tools require an electromagnetic solenoid utilizing a commercial source of power to run the motor. Such prior art efforts, however, suffer from the following disadvantages. In case of utilizing air pressure, a separate air-compressor is required, and in case of an electromagnetic solenoid, electromagnetic attraction occurs because the solenoid is integral with the tool the device becomes relatively heavy.

An electric tacker using a motor to the hammer is designed so that a percussion hammer is urged in a percussion direction by means of a spring, and the percussion hammer is moved in an urging direction of the spring by rotation of the motor. When the operating switch is turned ON, the percussion hammer held at the position of the top dead center is pushed down by the force of the spring and the hammer head secured to the hammer impacts the needle mounted on the magazine to hammer a material to be hammered.

A problem occurs, however, where a motor is used to power the tool, and the motor continues its rotation during the operation of the switch operating lever, and thereby causing a succeeding needle to be hammered on the already hammered needle unless the tacker is moved immediately after one needle has been hammered or the switch is turned off. Also, even if the user turns off the switch in a timely fashion, the motor or a driving cam is difficult to stop suddenly due to their inertia, and double-hammering of needles often results regardless of such efforts. In an attempt to overcome this problem, the invention disclosed in Japanese Patent Application Laid-Open No. 135182/1985 has been proposed. This patent application discloses the use of control means which comprises a cam switch driven by a switch cam, a main switch composed of a double switch and a braking resistor. In the electric control means, previously mentioned above, there are many parts which increase the cost of the tool, and it is difficult to adjust timing between both the switches. In addition, the needle hammered by the hammer head is not always completely hammered depending on the nature of the material to be hammered. In such instances, only the hammer head is pushed down while maintaining the succeeding needle so as not to come out until the incompletely hammered needle is hammered again. This is commonly referred to as "idle hammering".

Although, the electric tacker, as described above, is provided with a spring force adjusting mechanism for the spring for urging the percussion hammer in the percussion direction, the tacker is not equipped with an idle hammering mechanism. Thus, the tacker sometimes failed to sufficiently cope with the situation only being equipped with the spring force adjusting mechanism for the spring.

In addition, in all such tools, the number of needles mounted on the magazine is limited and the quantity of needles is reduced as hammering proceeds. A mechanism indicative of the remaining number of needles is not equipped in the conventional electric tacker. Accordingly, in normal operation, one does not become aware of the fact that needles are empty until no needle is hammered out.

OBJECTS OF THE INVENTION

It is an object of the present invention to provide an electric tacker embodying a continuous hammering preventive mechanism capable of operation in a stable and reliable manner with less number of parts.

It is a further object of the invention to provide an electric tacker with an idle hammering mechanism which has not been provided in conventional electric tackers.

It is another object of the invention to provide an electric tacker with a mechanism for indicating the remaining number of needles which are available for use.

These and other objects and novel features of the present invention will become more apparent by reading the following detailed description in connection with the accompanying drawings. It is to be noted that the drawings are merely provided for explanation but not in a sense to limit the scope of the invention.

BRIEF DESCRIPTION OF THE DRAWINGS

The drawings show one embodiment of the present invention.

FIG. 4 is a partially cutaway front view showing the state wherein an operating lever is lifted, a percussion hammer is moved down to hammer a needle and a switch is turned ON;

DETAILED DESCRIPTION OF THE INVENTION

Figure 1:
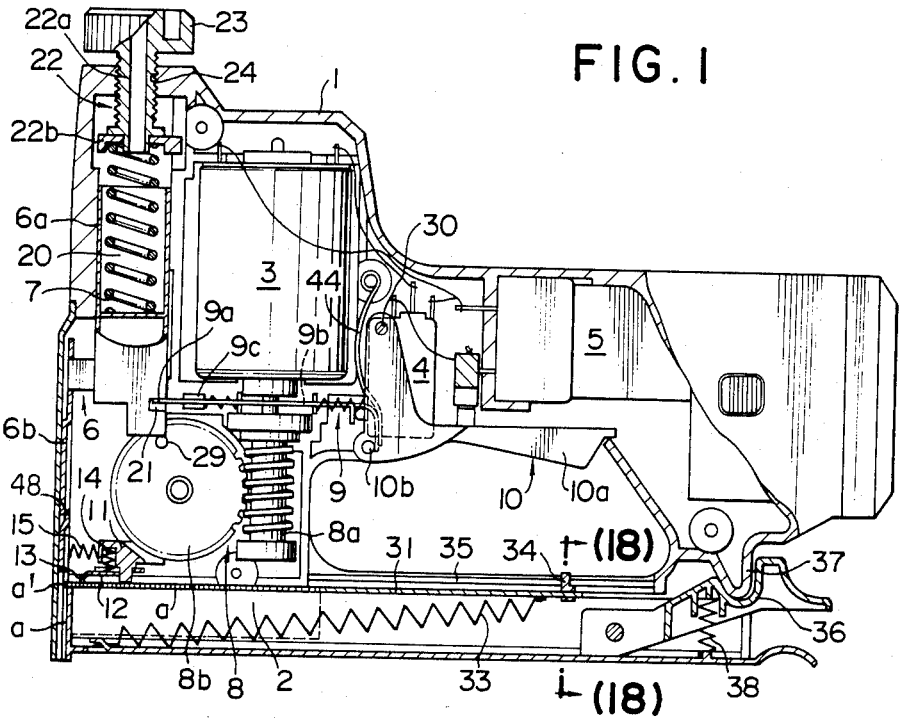
FIG. 1 is a partially cutaway front view showing the state wherein the device is not in used.
Figure 2:
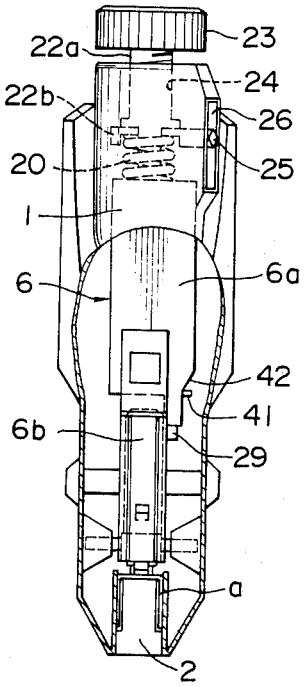
FIG. 2 is a partially cutaway side view of the same.
Figure 3:
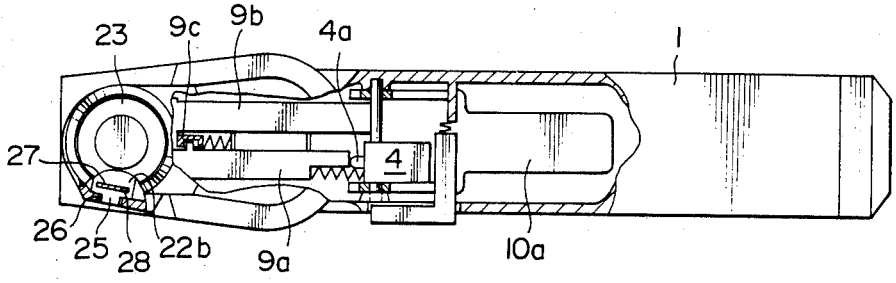
FIG. 3 is a partially cutaway plan view of the same.

An embodiment of the present invention will now be described with an electric tacker of a cordless type having a battery housed therein. In the drawings, there is provided a housing indicated at 1, in which a magazine 2 encasing a needle a is mounted on the bottom internally of the housing 1, and a finger hole extending through in a lateral direction is bored in the central portion thereof whereby a grip is integrally formed at the upper part.

A motor 3 and a switch 4 are arranged interiorly of the housing 1, and a battery 5 is encased interiorly of the grip, the motor 3, the switch 4 and the battery 5 being electrically connected. Within the housing 1, a percussion hammer 6 is vertically slidably arranged along the front wall thereof, and a spring 7 for urging the hammer in a direction of hammering a needle a is held above the percussion hammer 6 through a spring force adjusting means. A driving member 8 for raising and moving the percussion hammer 6 pushed down by the force of the spring 7 is arranged within the range wherein the hammer 6 is moved up and down so that the driving member 8 may be operated by the motor 3. A retainer mechanism 9 for catching and retaining the percussion hammer 6 at a predetermined position of the top dead center and a switch operating mechanism 10 for actuating the retainer mechanism 9 and turning the switch 4 ON and OFF are disposed on the lower surface of the grip.

The percussion hammer 6 is composed of a hammer cam 6a having a prismatic shape and with a lower half portion at the rear thereof cut to form a recess, and a hammer head 6b engaged with a pin secured to the front surface of the hammer cam 6a through a hole. The hammer head projects downwardly, and the hammer cam 6a is formed at the lower part of a spring 7 with a depression 20 for receiving a lower portion of the spring 7. The spring has an engaging recess 21 at the lower portion of the back of the spring into which a switch plate 9a of the retainer mechanism 9 is fitted and engaged. The retainer mechanism is formed at its lower portion on the outer surface with an offset portion 42 for moving a connector plate 9b in a horizontal and lateral direction. The spring 7, with one end fitted and engaged with the hammer cam 6a of the percussion hammer 6, has its upper end engaged at a spring force adjusting device 22 provided at the upper part of the housing 1 to always urge the hammer 6 in a hammering direction of a needle. The adjusting device 22 consists of a rotational screw rod 22a meshed with a threaded hole 24 formed at the upper part of the housing 10 and a spring receiving plate 22b in engagement with the screw rod 22a. The rotational screw rod 22a has a knob 23 which is secured to a portion projected from the housing 1 and a slip-out preventive stopper mounted at a position in abutment with the inner surface of the housing 1. The rotational screw rod 22a is adapted to be moved up and down within the range of the length of the screw rod 22a. The spring receiving plate 22b engaged with the rotational screw rod 22a causes a projected element 25 provided on the side peripheral surface to fit into a guide groove 26 formed in the side wall of the housing 1, whereby the spring receiving plate 22b is stopped from its rotation and may be slidably moved up and down along the guide groove 26 to variably adjust the amount of compression of the spring 7 to adjust the intensity of the spring force by which the hammer is pushed down. A lateral slot 27 is bored inwardly of the projected element 25 of the spring receiving plate 22b which is moved up and down by the rotation of the knob 23, and a spacer 28 capable of covering an opening of the guide groove 26 is fitted and mounted on the lateral slot 27 whereby closing a clearance created upwardly of the guide groove 26 as the plate 22b moves down.

The projected element 25 of the spring receiving plate 25b fitted in the guide groove 26 is made to be exposed so that it may be visualized from outside to serve as a gauge of the amount of compression displacement of the spring 7.

A driving member 8 for pushing up the percussion hammer 6 to the neighbourhood of the top dead center is composed of a worm gear 8a connected and secured to an output shaft of the motor 3 and a worm wheel 8b meshed with the worm gear 8a. The worm wheel 8b has a center shaft held by receiving portions provided on both side walls of the housing 1 in addition to having an engaging projection 29 provided on the outer surface of the worm wheel. The engaging projection 29 is designed to come into abutment with the lower end of the hammer cam 6a of the percussion hammer 6 to push up the percussion hammer 6 after the percussion hammer has completed its hammering to the vicinity of the top dead center. It is to be noted that the engaging projection 29 provided on the side of the worm wheel 8b is not limited to the provision thereof on one side but they may be provided on both sides of the worm wheel 8b.

The retainer mechanism 9 for engaging and retaining the percussion hammer 6, pushed up to the neighbourhood of the top dead center by the driving member 8, is composed of a switch plate 9a detachably fitted in the recess 21 of the hammer 6a, and a push button 4a, for the present the switch 4, and a connector 9c for connecting a connector plate 9b adapted to operatively connect the switch plate 9a and both plates 9a, 9b.

The connector 9c has a groove 45 which merely guides a moving stroke portion in a lateral direction of the switch plate 9a and is always biased frontwardly by means of a return spring 46 for returning it to a reset state. The connector plate 9b is urged towards the outer surface of the hammer cam by means of a spring 47.

A switch operating mechanism 10 for actuating the switch plate 9a through the connector plate 9b of the retainer mechanism 9 is composed of an operating lever 10a and a pin 10 fixedly projected on the operating lever 10a. The operating lever 10a has a base rotatably supported on a shaft 30, the pin 10b being placed in abutment and engagement with the front surface of the engaging portion of the connector plate 9b, whereby rotation about the shaft 30 caused by raising the operating lever 10a causes the pin 10b to pull the connector plate 9b rearwardly so that the switch plate 9a is moved rearwardly through the connector 9c to turn ON the switch 4.

Above the magazine 2 and at the rear of the hammer head 6b, a slider 11 is laterally slidably mounted on the housing 1, and a needle catch element 12 having a catch portion 13 adapted to be disengageable with an upper side portion a' of the needle a is vertically swingingly mounted on the lower side of the slider 11. The catch element 12 is biased downwardly by means of a coil spring 14 encased at a position frontwardly from the mounting position with respect to the slider 11. The slider 11 is biased rearwardly by the force of a coil spring 15 retained between the rear surface of the hammer head 6b and the circular recess formed in the slider 11.

The slider 11 comprises a block body formed of a synthetic resin and formed into a rectangular configuration in plan, in which guide projections 16, 16' are integrally projected outwardly on the left and right sides. The guide members 16, 16' extend through guide slots 17, 17' formed in left and right walls of the housing 1 so that they may be projected outside. These guide projections 16, 16' and guide slots 17, 17' cause the slider 11 to be slidably moved in a lateral direction. The width of movement of the slider 11 is determined by the length of the guide slots 17, 17'.

The needle catch element 12 comprises a rectangular metal flat plate, in which a catch portion 13 in engagement with the upper side portion a' of the needle a is formed to be bended downwardly in the central portion widthwise of one side thereof. The bended portion has an inclined surface 13' through approximately 45°, and the needle catch element 12 is moved sideway by abutment of the lower end of the hammer head 6b with the inclined surface 13'. The needle catch element 12 is bored approximately in the central position with a rectangular mounting hole 18, which hole is fitted in a mounting rod 19 projected on the lower surface of the slider 11 to thereby provide an integral engagement.

The magazine 2 is constructed such that a retaining frame 2b having substantially a ] shape section, formed to be narrower than the width of a web-like flat plate 2a, is integrally joined and secured to the upper surface of the flat plate 2a with a longitudinal opening directed upwardly. The magazine 2 has a pusher 31 laterally slidably capped on the magazine. The pusher is bended into a substantially ] shape which is substantially the same shape as that of the needle a. A spring device 33, such as a tension spring, is extended between an engaging element 31' formed on the pusher 31 and an engaging element 32 formed on the inner bottom of the magazine 2 so that the pusher 31 may be always urged in a direction of pressing the needle a.

A display body 34 formed into a substantially H-shape section is integrally mounted at the rear end of the pusher 31. The display body 34 is snapped into the guide groove 35 with a part thereof exposed externally of the housing 1, the display body 34 being also moved along the guide groove 35 as the pusher 31 moves.

An engaging lever 36 is vertically swingingly mounted at the rear of the magazine 2 so that it may be engaged with and disengaged from an engaging projection 37 formed at the lower portion at the rear of the housing 1. The engaging lever 36 is biased in a direction of engaging the engaging projection 37 by means of a spring 38. Relatively engaging stoppers 39a, 39b are provided on the inner surface of the magazine 2 and the pusher 31, respectively, so that when the needle a is not present, the pusher to be moved forward by the force of the spring device 33 may be engaged at a position not in contact with the hammer head 6b of the percussion hammer 6.

Figure 4:
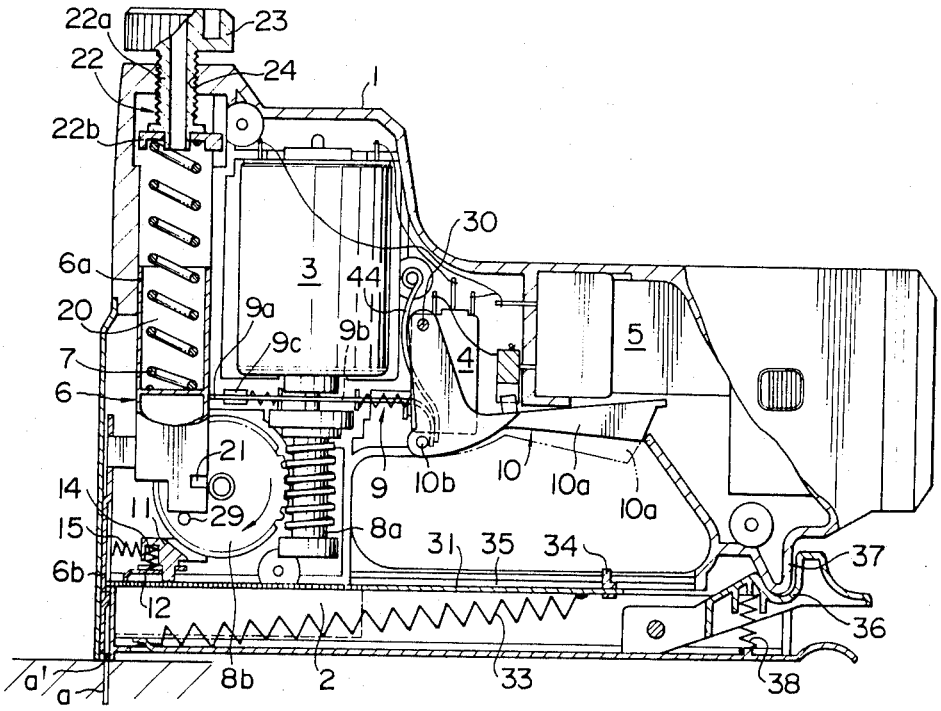
Figure 7:
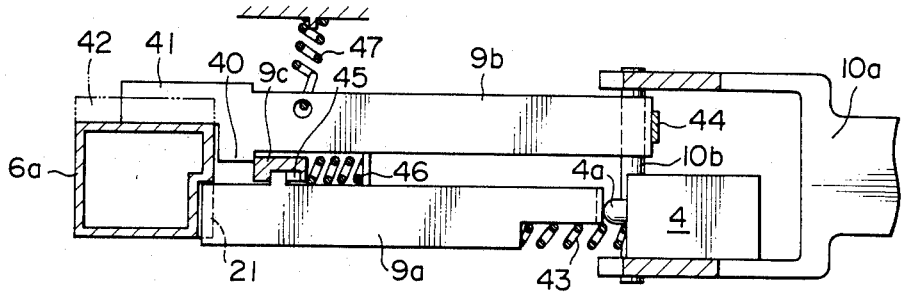
FIGS. 7 to 10 are respectively cross-sectional views showing the relationship between a switch plate, a connector plate, a hammer cam and a switch in the state shown in FIGS. 1, 4, 5 and 6.
Figure 8:
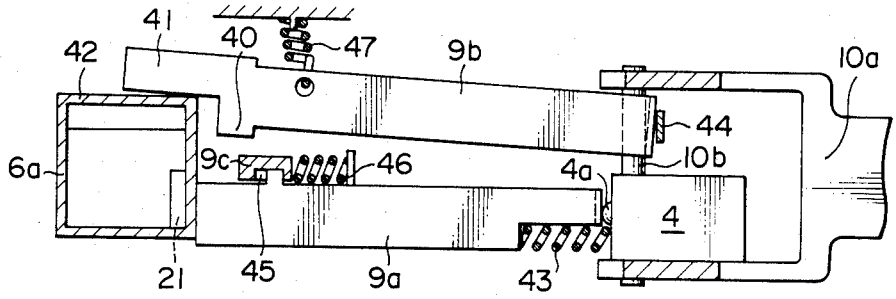
Figure 9:
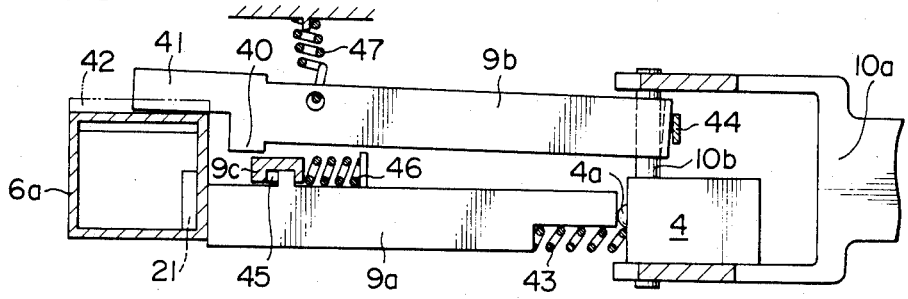
Figure 10:
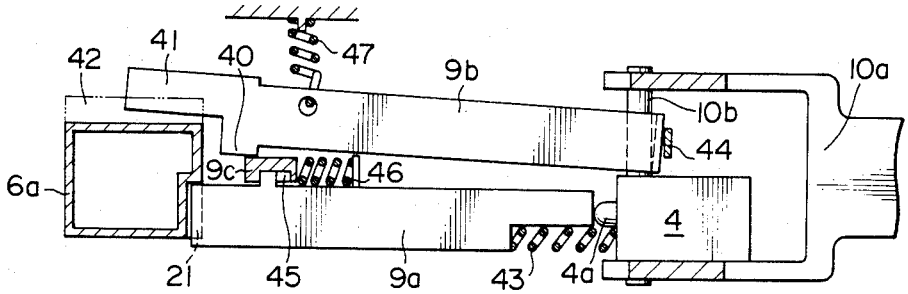
Figure 11:
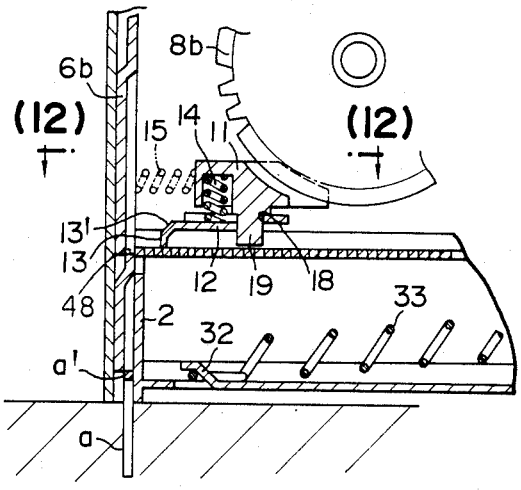
FIG. 11 is a partially cutaway front view showing essential parts in a normal state wherein a needle is hammered.
Figure 12:
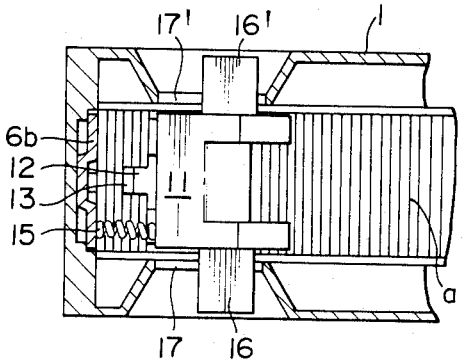
FIG. 12 is a cross-sectional view taken on line 12—12 of FIG. 11.
Figure 13:
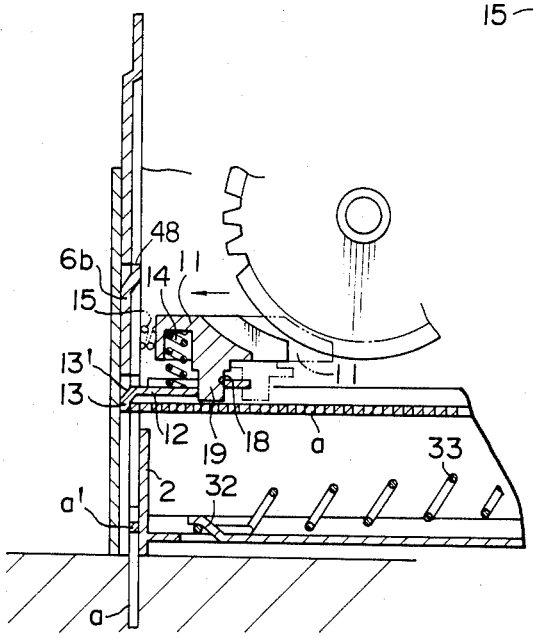
FIGS. 13 to 16 are respectively partially cutaway front views showing the idle hammering operation.
Figure 14:
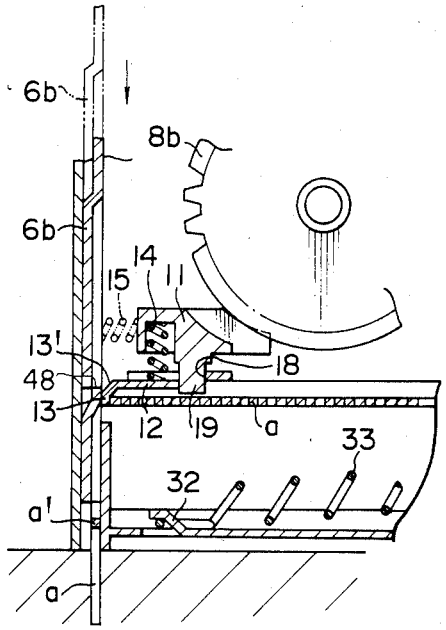
Figure 15:
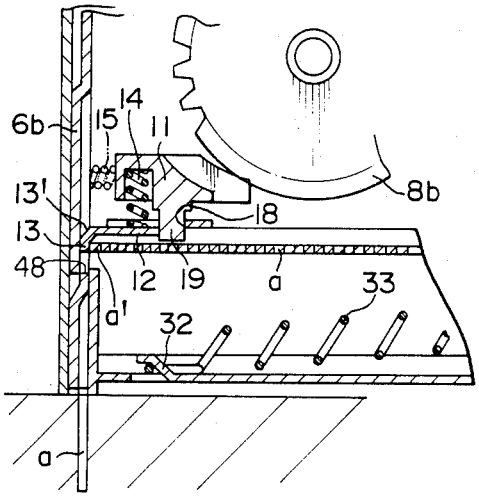
Figure 16:
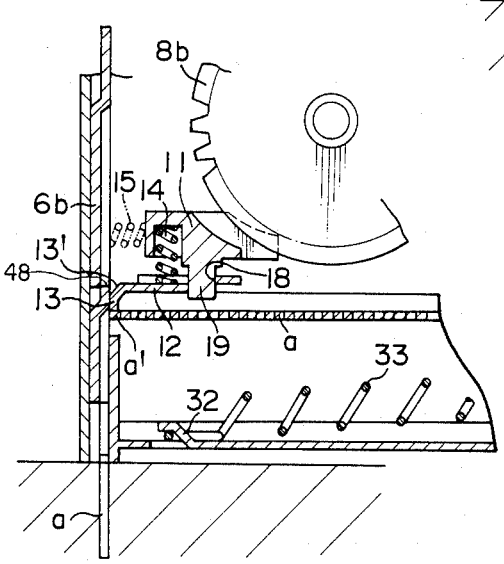
Figure 17:
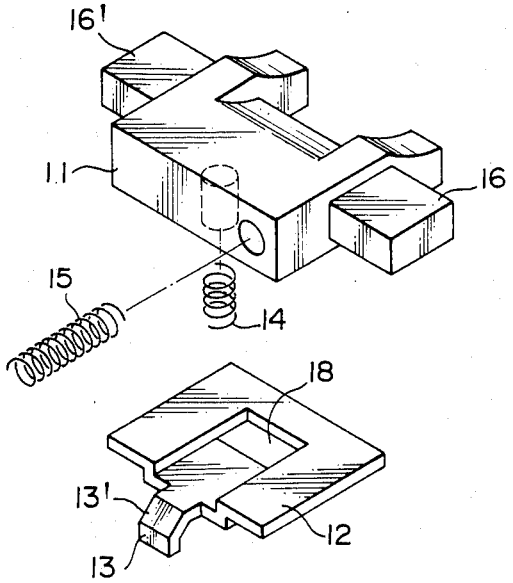
FIG. 17 is an exploded perspective view showing a slider and a needle catch element.
Figure 18:
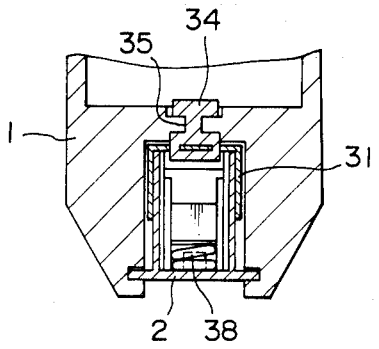
FIG. 18 is an enlarged sectional view taken on line 18—18 of FIG. 1.
Figure 19:
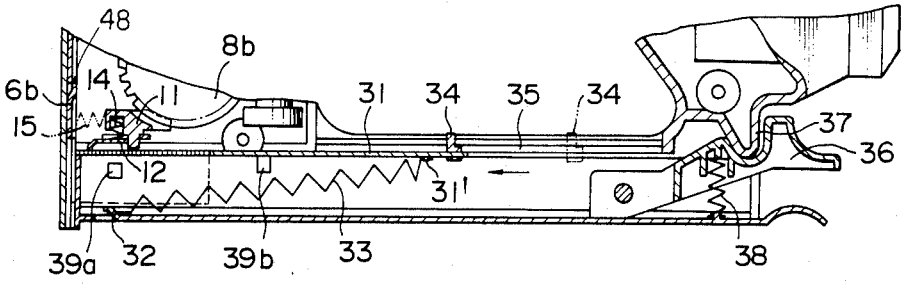
FIGS. 19 and 20 are respectively partially cutaway front views of essential parts showing the movement of a display body as a needle hammers.
Figure 20:
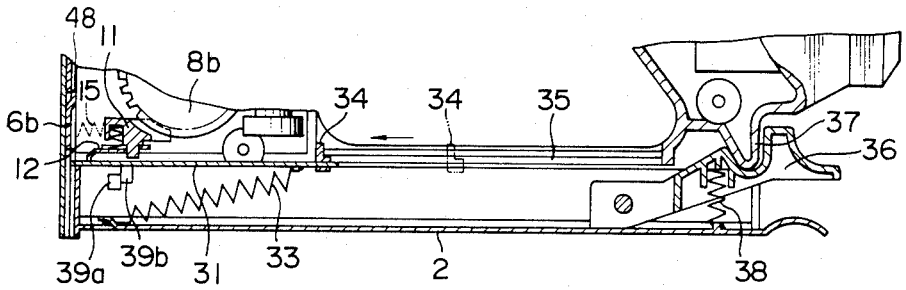
Figure 21:
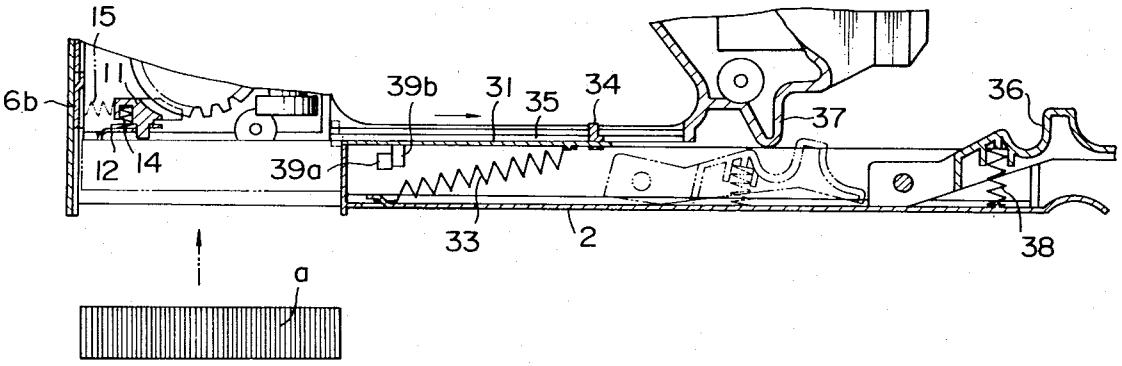
FIG. 21 is a partially cutaway front view showing the state wherein a magazine is pulled out to mount a needle.
Figure 22:
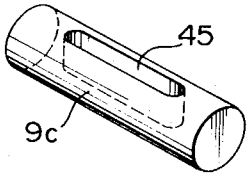
FIG. 22 is a perspective view showing a connector.

Next, operation of the above-mentioned tacker will be described. First, when the operating lever 10a is raised from the OFF state of switch in FIGS. 1 and 7, the connector plate 9b is pulled rearwardly by the pin 10b as the lever 10a rotates, and the movement of the connector plate 9b causes the catch projection 40 to move the switch plate 9a rearwardly through the connector 9c. As a result, the end of the switch plate 9a becomes disengaged from the recess 21 of the hammer cam 6a, and the percussion hammer 6 is pushed down in a hammering direction of the needle by means of the force of the spring 7, thus hammering the needle a by the hammer head 6b. At essentially the time, the switch plate 9a is moved rearwardly to depress the push button 4 of the switch 4 to turn ON the switch 4 whereby the motor 3 is driven to actuate the driving member 8. The connector plate 9b which caused the switch plate 9a to move by the downward movement of the percussion hammer 6 causes the operating projection 41 to be pushed outward by movement of the offset portion 42, the catch projection 40 assuming the position disengaged from the connector 9c. (See FIGS. 4 and 8.)

Figure 5:
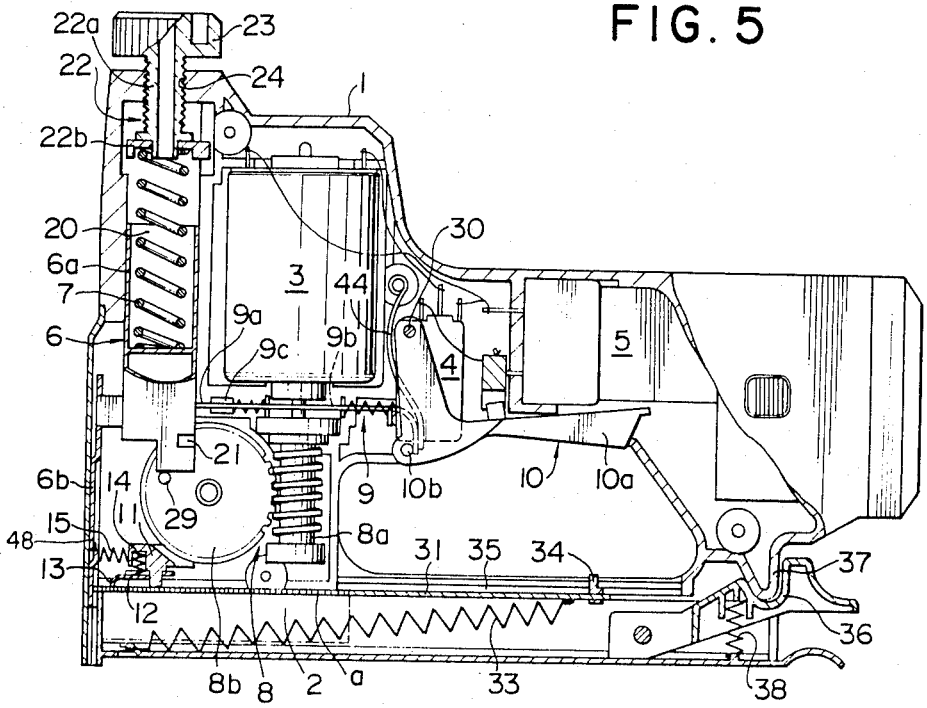
FIG. 5 is a partially cutaway front view showing the state wherein the percussion hammer is pushed up.
Figure 6:
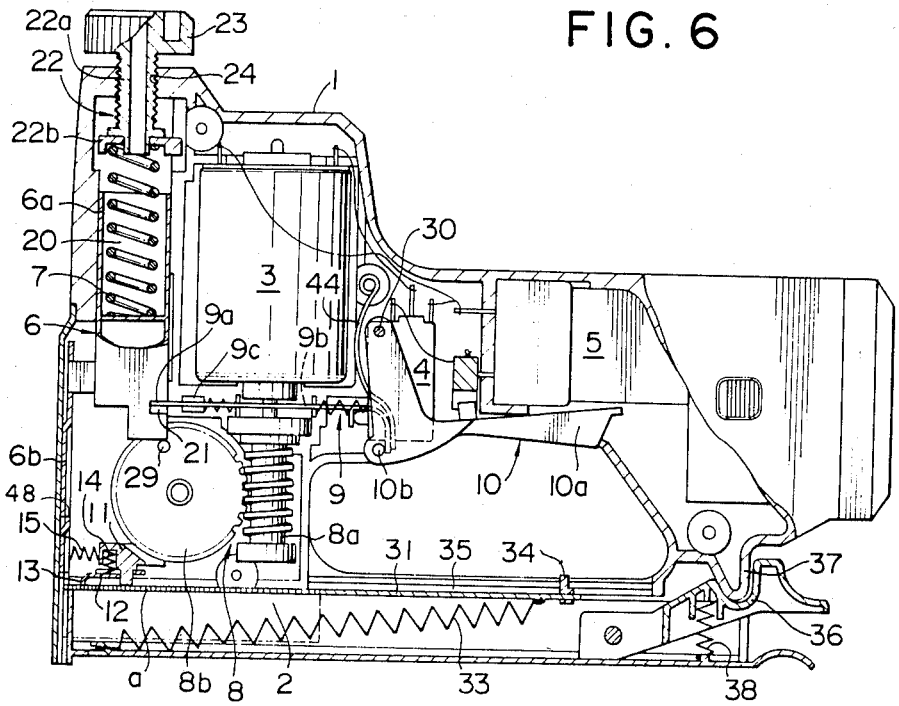
FIG. 6 is a partially cutaway front view showing the state wherein the percussion hammer is held at the neighbourhood of the top dead center and the switch is turned OFF.

The percussion hammer 6, having completed its percussion, is pushed upward by the abutment of the engaging projection 29 provided on the work wheel 8b with the lower end of the hammer cam 6a by the operation of the driving member 8 (see FIG. 5) and the percussion hammer 6 is pushed up to the neighbourhood of the top dead center. As a result, the end of the switch plate 9a is biased forwardly by the force of the return spring 44 and fitted in and engaged with the recess 21 of the hammer cam 6a to engage with and retain the percussion hammer 6 in the neighbourhood of the top dead center and at the same time, the switch 4 is turned OFF. At substantially the same time, the worm wheel 8b is rotated due to its inertia and the engaging projection 29 is disengaged from the lower end of the hammer cam 6a as the case may be. However, even in that case, it is so controlled by short-circuiting terminals of the motor that the worm wheel may not be rotated more than half-rotation (see FIG. 6).

When the operating lever 10a remains raised in the above-described state, since the catch projection 40 of the connector 9b is in abutment with the side of the connector 9c, it becomes impossible to move the switch plate 9a backward and the switch is never turned ON again, thus preventing the continuous hammering phenomenon of needles. Accordingly, when the needle a is hammered again, the raising of the operating lever 10a is released whereby the connector plate 9b is moved forward by the force of the return spring 44 and the catch projection 40 engages the front end of the connector 9c and returns to its initial state. As a result, when the operating lever 10a is raised, the connector plate 9b causes the switch plate 9a to move rearward through the connector 9c and the percussion hammer 6 to be pushed down, the switch being turned ON to push up the hammer, having completed its hammering, thus repeating the operation similar to that as previously mentioned.

When the needle a cannot be completely hammered into the material to be hammered by the above-described operation, the idle hammering mechanism is operated to effect the idle hammering. First, in preparation of the idle hammering, when the slider 11, which is positioned above the magazine 2 and at the rear of the hammer head 6b and laterally slidably mounted on the housing 1, is urged to be moved toward the hammer head 6b against the force of the coil spring 15, the needle catch element 12 mounted on the underside of the slider 11 is pushed down by the force of the coil spring 14 at the position over the first needle, and the catch portion 13 of the needle catch element 12 is brought into engagement with the front end of the upper side of the first needle. When the operating lever 10*a* is raised, upon completion of the aforesaid setting, the percussion hammer 6 is moved downward with the result that the hammer head 6*a* is moved down. Then subsequently, the lower end of the hammer head 6*b* comes into sliding contact with the catch portion 13 of the needle catch element 12 to force the element 12 backward. Consequently, the first needle is moved together therewith from a position directly below the hammer head 6*b* toward the side (rearward). As a result, the hammer head 6*b* is moved down without hammering the needle a, thus effecting the idle hammering.

Thus, where a state occurs wherein the needle is not completely hammered due to the nature of material to be hammered or hammering pressure or the like, the operation is made as described above to effect the idle hammering. As a result it is possible to render an incomplete needle in a complete hammering state. In FIGS. 1, 5, 6, 11, 13–16, 19 and 20, a catch offset shoulder portion 48 is shown. The catch offset shoulder portion 48 is expanded in the middle of the rear surface of the hammer head 6*b* so as to be directed rearwardly. Such configuration permits the catch offset shoulder portion 48 to engage the catch portion 13 of the stable catch element 12 when the hammer head 6*b* is returned to its original state in order to lift the catch portion 13 so that the catch portion 13 is positioned upwardly of the upper side portion a′ of the staple a. Subsequently, the catch offset shoulder portion 48 is urged back to its original position due to the resilient force of the coil spring 15 so as to allow the staple a to be hammered. If the percussion hammer 6 is moved down under the state wherein the slider 11 is positioned at a backward position away from the hammer head 6*b*, since the needle catch element 12 mounted on the slider 11 is rest on the upper side portion of the needle at the rear of the foremost needle, the hammer head 6*b* impacts the needle to hammer the material to be hammered.

Furthermore, where the force of the coil spring 15, for urging the slider 11 backward, is made to be greater than the force of the spring device 33 of the pusher 31, for urging the needle a forwardly, the slider 11 is forced forward against the force of the coil spring 15. Since the force of the coil spring 15, for rearwardly urging the slider 11 when the catch portion 13 of the needle catch element 12 is engaged with the front end of the upper side portion a′ of the needle a, is greater than the force of the spring device 33, for urging the needle a forwardly, the needle a is engaged with the needle catch element 12 and forced toward the side (rearward) from a line through which the hammer head 6*b* passes, thus assuming the state wherein the idle hammering may be accomplished continuously. In this case, in order to return the mode to the normal using condition, the slider 11 is manually operated to release the engagement between the needle a and the needle catch element 12.

Needles hammered by the operation of the percussion hammer are successively being pressed for forward movement along the outside of the retainer frame 2*b* in the magazine. The display body 34, integrally provided on the pusher 31, is also fitted in the guide groove 35 formed in the housing 1 and moved together therewith toward the terminal end of the guide groove 35. Thus, the display of the remaining quantity of the needles a attached to the magazine 2 is provided depending on the position of the display body 34 in the guide groove 35.

What is claimed is:

1. An electric tacker comprising: a housing for encasing needles, said housing having a bottom and a magazine mounted on said bottom wherein said housing contains:

(a) a percussion hammer having a hammer head for impacting said needles, (b) a spring for urging said hammer in an impacting direction against the needles, (c) a driving member for moving said percussion hammer in an urging direction of the spring actuated by rotation of a motor, (d) a retainer mechanism for engaging with and retaining said percussion hammer moved towards a biasing direction of said spring under an action of said driving member at a predetermined position of the top dead center of the driving member, and (e) a switch operating mechanism for actuating said retainer mechanism in cooperation with a turning-on or turning-off the switch, said retainer mechanism comprising:

(i) a switch plate for reciprocally moving a switch push-button simultaneously with a switch fitting with respect to an engaging recess of a hammer cam of said percussion hammer, (ii) a connector plate cooperatively driving said switch plate, and (iii) a connector for cooperatively connecting said switch with said connector plate, wherein a pin fixed to an operation lever of said switching operating mechanism abuts against and engages with a front surface of an engaging part of said connector plate, and wherein a slider is positioned above said magazine and at a rear part of said hammer head, said slider being attached to said housing in such a way as to permit said slider to reciprocally move forward and backward, and wherein a needle catch element is fixed to a lower side of said slider in such a way to permit said needle catch element to move upwardly and downwardly simultaneously as said slider is biased by said springs towards a rear part of said hammer head.

2. An electric tacker in accordance with claim 1, wherein said slider is laterally movably mounted on said housing while being positioned above said magazine and at the rear of said hammer head, and said needle catch element is vertically mounted in a resilient manner on an underside of said slider, said slider being urged at the rear of said hammer head by means of said spring.

3. An electric tacker in accordance with claim 1, wherein said magazine has a substantially shape section and includes:

is a pusher adapted to slide along the outer periphery of said magazine to urge in a direction of pushing out the needle said needle by means of a spring device, and (ii) a display body exposed externally of said housing integrally mounted on said pusher, said display body being snapped in a guide groove formed in said housing.

4. An electric tacker claim 1, wherein a battery is encased in said housing.

* * * * *

UNITED STATES PATENT AND TRADEMARK OFFICE

CERTIFICATE OF CORRECTION

PATENT NO. : 4,724,992

DATED : Febraury 16, 1988

INVENTOR(S) : Toshitaka OHMORI

It is certified that error appears in the above-identified patent and that said Letters Patent is hereby corrected as shown below:

In the Abstract, line 2, change "covered" to ---powered---.

In the Abstract, line 6, insert ---,--- after "needles".

At column 1, line 14, insert ---,--- after "tack".

At column 1, line 14, insert ---,--- after "needle".

At column 1, line 30, insert ---power--- after "to".

At column 1, line 42, delete "and".

At column 1, line 68, change "for" to ---associated with---.

At column 2, line 4, change "failed" to ---fails---.

At column 2, line 20, change "less" to ---fewer---.

At column 2, line 41, change "used" to ---use---.

At column 3, line 15, italicize "a" (second occurrence).

At column 3, line 26, italicize "a" (third occurrence).

At column 3, line 49, change "its" to ---the---.

At column 3, line 50, change "the" to ---its---.

At column 4, line 17, change "25b" to ---22b---.

At column 4, line 22, change "neighbourhood" to ---vicinity---.

UNITED STATES PATENT AND TRADEMARK OFFICE

CERTIFICATE OF CORRECTION

PATENT NO. : 4,724,992

DATED : February 16, 1988

INVENTOR(S) : Toshitaka OHMORI

It is certified that error appears in the above-identified patent and that said Letters Patent is hereby corrected as shown below:

At column 4, lines 39-40, change "neighbourhood" to ---vicinity---.

At column 4, line 41, insert ---,--- after "9a".

At column 5, line 1, italicize "a" (second occurrence).

At column 5, line 23, italicize "a" (second occurrence).

At column 5, line 27, change "sideway" to ---sideways---.

At column 5, line 31, change "which" to ---said---.

At column 5, line 31, delete "is".

At column 5, line 42, italicize "a" (first occurrence).

At column 5, line 47, italicize "a".

At column 5, line 49, change "shape" to ---shaped---.

At column 5, line 62, italicize "a".

At column 6, line 10, italicize "a" after "needle".

At column 6, line 11, insert ---same--- after "the" (second occurrence).

At column 6, line 46, italicize "a".

At column 6, line 59, italicize "a".

At column 7, line 8, change "Then subsequently," to ---Subsequently,---.

At column 7, line 16, italicize "a".

At column 7, line 32, italicize "a" (second occurrence).

UNITED STATES PATENT AND TRADEMARK OFFICE

CERTIFICATE OF CORRECTION

PATENT NO. : 4,724,992

DATED : February 16, 1988

INVENTOR(S) : Toshitaka OHMORI

It is certified that error appears in the above-identified patent and that said Letters Patent is hereby corrected as shown below:

At column 7, line 35, italicize "a".

At column 7, line 39, change "is rest" to ---rests---.

At column 7, line 44, change "backward" to ---backwards---.

At column 7, line 46, italicize "a".

At column 7, line 51, italicize "a" (second occurrence).

At column 7, line 52, italicize "a".

At column 7, line 53, italicize "a".

At column 7, line 60, italicize "a".

At column 7, line 68, italicize "a".

At column 8, line 34, change "switching" to ---switch---.

At column 8, line 56, change "shape" to ---shaped---.

At column 8, line 58, change "is" to ---(i)---.

At column 8, line 66, insert ---as set forth in --- after "tacker".

Signed and Sealed this

Twenty-ninth Day of August, 1989

*Attest:*

*Attesting Officer*

DONALD J. QUIGG

*Commissioner of Patents and Trademarks*